US011655603B2

(12) United States Patent
Thompson, III

(10) Patent No.: US 11,655,603 B2
(45) Date of Patent: May 23, 2023

(54) RESILIENT WATERFRONT PLATFORM

(71) Applicant: Arthur Hagar Thompson, III, San Francisco, CA (US)

(72) Inventor: Arthur Hagar Thompson, III, San Francisco, CA (US)

( * ) Notice: Subject to any disclaimer, the term of this patent is extended or adjusted under 35 U.S.C. 154(b) by 0 days.

(21) Appl. No.: 17/395,378

(22) Filed: Aug. 5, 2021

(65) Prior Publication Data

US 2023/0040756 A1 Feb. 9, 2023

(51) Int. Cl.
*E02B 3/06* (2006.01)
*E02B 3/12* (2006.01)

(52) U.S. Cl.
CPC ..... *E02B 3/062* (2013.01); *E02B 3/066* (2013.01); *E02B 3/122* (2013.01)

(58) Field of Classification Search
CPC ..... E02B 3/062; E02B 3/066; E02B 3/122; Y02A 10/11; Y02A 10/23
See application file for complete search history.

(56) References Cited

U.S. PATENT DOCUMENTS

| | | | | |
|---|---|---|---|---|
| 1,247,750 | A | 11/1917 | Upson | |
| 4,653,240 | A | 3/1987 | Jenn | |
| 4,728,225 | A | 3/1988 | Brandl et al. | |
| 5,697,736 | A | 12/1997 | Veazey et al. | |
| 6,379,085 | B1 * | 4/2002 | Vanderklaauw | E04G 1/17 405/230 |
| 10,246,842 | B2 | 4/2019 | Van Reijen et al. | |
| 10,619,317 | B2 | 4/2020 | Waters, Jr. | |
| 2012/0177445 | A1 * | 7/2012 | Wendt | E02D 5/285 405/231 |
| 2014/0133912 | A1 * | 5/2014 | Kawahara | E02B 3/062 405/21 |
| 2017/0241091 | A1 | 8/2017 | Van Reijen et al. | |

FOREIGN PATENT DOCUMENTS

| | | | | |
|---|---|---|---|---|
| JP | 09279540 | * 10/1997 | | Y02A 10/11 |
| JP | 2003064633 | * 3/2003 | | Y02A 40/81 |

OTHER PUBLICATIONS

Boston Public Works Department, "Climate Resilient Design Standards & Guidelines for Protection of Public Right of Way", 2018 (Year: 2018).*

* cited by examiner

*Primary Examiner* — Carib A Oquendo
(74) *Attorney, Agent, or Firm* — Fenwick & West LLP

(57) ABSTRACT

The EPX2 Resilient Waterfront Platform is a new and useful process, a resilient building technology that provides for the efficient adaptation and safeguard of waterfronts against adverse events. It is an optimized, elevated Waterfront Resiliency infrastructure solution that is legible, practical, high quality, highly efficient, and deployable, and provides a timely go-to standard for new and existing Waterfront communities and historic districts at risk to Climate Change. One purpose of this resilient building technology is to improve public safety and minimize property damage in response to accelerating climate change forces, including seismic, flooding, and sea level rise. The platform assembly is comprised of several components including elevated sea walls, wharves, piers, buildings, accessways and the rehabilitation of historic architecture components, as applicable. It is an effective, practical, and permanent solution to resist natural forces, while providing a modernized platform for a variety of waterfront experiences.

21 Claims, 1 Drawing Sheet

RESILIENT WATERFRONT PLATFORM

BACKGROUND

1. Technical Field

This disclosure relates generally to resilient waterfront platforms.

2. Description of Related Art

Waterfront protection has been in use for decades, even centuries, along oceans, bays, lakes, rivers, or other flowing or non-flowing bodies of water with changing water levels to safeguard land, buildings, and communities from flooding. Forms of waterfront protection infrastructure vary, can be natural or manufactured, including a variety and combination of seawalls, dikes, and levees.

Existing waterfronts often include an amalgam of varying waterfront protection infrastructure components including a seawall, accessway, wharves, piers, and buildings, in a variety of landside and waterside arrangements, sometimes in suboptimal structural configurations, and developed sporadically over those decades and centuries of time.

Along many waterfronts, this existing waterfront protection infrastructure is aging, has reached or exceeded its useful service life. Some is in poor condition, crumbling, even unsafe. This existing infrastructure already threatens public health and safety and is need of repair, rehabilitation, or replacement.

Global warming compounds the problem, further limits the effectiveness of existing or aging waterfront protection infrastructure. This infrastructure was not designed for the climate change challenges of today.

Climate change is causing sea levels to rise, and to rise at an accelerating pace. Storm frequency and intensities are increasing. Sunny day tidal flooding is now common and increasing in frequency in low-lying communities. Sea levels could rise several feet in the next century.

"There's no scenario that stops sea level rise in this century. We have got to deal with this indefinitely. Without action, rare, catastrophic storm surges will become common within 30 years. What was a 100-year event is a yearly event by 2050."—Michael Oppenheimer, climate scientist, a lead author of the 2019 Special Report on the Ocean and Cryosphere in a Changing Climate (SROCC) for the United Nations Intergovernmental Panel on Climate Change (IPCC).

Higher floodwater levels are unsafe. Rising, fast-moving floodwaters can be hazardous and cause extensive waterfront damage. Coastal floods can be extremely dangerous and cause severe damage when high waters and storm surge are combined with the destructive forces of waves.

Driven by climate change, the floodwater levels of tomorrow will be higher than the floodwater levels of today.

The elevations and heights of existing waterfront protection infrastructure are often outdated and too low to combat these higher floodwater levels of tomorrow, making them unsafe and subject to possible failure.

Given the threat of climate change, disaster prevention and resiliency responses are high on the priority list of communities and countries around the world to mitigate risk from floods and sea level rise, protect the public and human safety, and prevent economic loss.

Without strong adaptation responses, most low-lying coasts, communities, and coastal megacities face substantial and increasing risk from coastal hazards.

The IPCC recognizes that choosing and implementing sea level rise responses present profound governance challenges. The complexity, time horizon and uncertainty of sea level rise, and the substantial impact expected, challenge established planning and decision-making practices, stifling the need for urgency.

Choosing and implementing adaptation responses are further challenged by a lack of resources; vexing trade-offs between safety, conservation, and economic development; multiple ways of framing the "sea level rise problem;" power relations; politics; and coastal stakeholders having conflicting interests in the future development of heavily used coastal zones.

The SROCC highlights the urgency of prioritizing timely, ambitious, and coordinated action to address unprecedented and enduring changes in the ocean and cryosphere. The report indicates the benefits of ambitious adaptation for sustainable development and, conversely, the escalating costs and risks of delayed action.

"The more decisively and the earlier we act, the more able we will be to address unavoidable changes, manage risks, improve our lives and achieve sustainability for ecosystems and people around the world—today and in the future."—Debra Roberts, Co-Chair of the United Nations IPCC Working Group II.

The United States National Trust for Historic Preservation adds that changemakers and regulatory flexibility are needed to save history or portions of it, or else historic buildings, districts, and waterfronts will be flooded, submerged, and permanently lost.

"Addressing the impacts that climate change and sea level rise will bring requires both policy makers and the preservation community to be flexible and willing to consider nontraditional solutions, such as moving buildings, raising them, or using newer, experimental approaches and building materials. To protect the old, we must embrace the new in the face of forces bigger than ourselves."—National Trust for Historic Preservation.

As one global example, in San Francisco, the existing waterfront is over 100 years old, deteriorating, historic, and too low, already below current floodwater levels in various locations, notwithstanding projected future sea level rise.

The existing, 100-year-old, four-mile-long seawall that protects the downtown Embarcadero waterfront and the City of San Francisco cannot withstand these future floodwater levels, sea level rise, and even earthquake disaster risk scenarios.

Enduring adaptation options for the Embarcadero are needed to protect the $100 billion-plus economic engine on the landside of this urban waterfront, rather than retreating from rising seas, walking away from this substantial economic value.

San Francisco has been struggling to find a resiliency solution for the Embarcadero for over seven years, since 2014, while focusing on shorter term, in situ, nonadaptation, floodproofing solutions for the historic finger piers. This approach likely prioritizes costs and historic fabric preservation over the protection of public health and safety.

The decision-making timeline has already been quite long and continues to stretch, perilously consistent with the dire governance warnings of the IPCC. Emergency readiness and preparedness diminishes with each passing day.

The potential of a sea level rise, flooding, seismic or other disaster is increasing, even accelerating for sea level rise. The time tracks are inversely proportional. As the length of time for resiliency decision making and solution execution increases, the length of time until the next natural disaster rushes closer.

There is a possible natural tendency for stakeholders to want to leave the treasured Embarcadero Historic District alone; to minimize or avoid the disaster risk; to consider less costly, less resilient, short-term workarounds; and to keep studying the problem, waiting and hoping for better visibility, better answers ahead.

For those stakeholders who have not experienced a climate change, seismic or similar disaster, like a Superstorm Sandy, Hurricane Katrina, or a Loma Prieta earthquake, or one recently, the challenge to act is more difficult.

Unfortunately, more recent Bay Area resiliency wake-up calls abound—deadly surprises like the Tubbs Fire, Camp Fire, Atlas Fire, and now, the COVID-19 pandemic and LNU, SCU, CZU Lightning Complex fires—and serve as serious reminders for the city, country, and the world to take prompt action on disaster prevention and preparedness.

Alternatively, embracing these climate change challenges with positivity futureproofs the San Francisco waterfront and its history, builds resiliency, avoids or minimizes disasters, while potentially unlocking new, exciting urban design opportunities along the water's edge. It is a once-every-century opportunity—to transform and create an updated version 2.0 of the Embarcadero, to add another layer of safety and history along the waterfront.

Saving history and the City of San Francisco from floods, sea level rise, and earthquakes is a complex issue. There are no resiliency standards or readily available resiliency solutions to solve these conflicting problems. Extraordinary, cost efficient, and timely measures are necessary.

The city needs a solution for the long-term resilience and sea level rise adaptation of the 100-year-old, deteriorating, structurally unfit, and too low Embarcadero seawall, promenade, and finger piers.

Action taken now, before an earthquake and advancing sea level rise, will reduce injuries, damage and losses to buildings and infrastructure, and shorten the San Francisco Bay Area's recovery time.

The need for resiliency and resilient waterfront infrastructure is timely and urgent. The protection of human health and safety, real property and the economy along global waterfronts is vital, as further highlighted in the recent $1.2 trillion USA Bipartisan Infrastructure Framework.

The framework includes the largest investment in the resilience of physical and natural systems in American history and prepares USA infrastructure, including waterfronts at risk, for the impacts of climate change and extreme weather events.

Like many coastal regions and waterfront locations around the world, an efficient, practical, and enduring resiliency solution is needed now and needs to be executed soon. Time is of the essence.

SUMMARY

The EPX2 Resilient Waterfront Platform (and various other embodiments) is a new and useful process, a resilient building technology approach that provides for the efficient adaptation and safeguard of waterfronts against adverse events. It includes an optimized, elevated Waterfront Resiliency infrastructure solution that is legible, practical, high quality, highly efficient, and deployable, and provides a timely go-to standard for new and existing Waterfront communities and historic districts at risk to Climate Change.

The EPX2 Resilient Waterfront Platform delivers an optimized and timely resiliency solution for coasts and waterfronts around the world. Some embodiments provide a standardized method and infrastructure configuration to solve the impacts of climate change and sea level rise, while providing an effective platform for a variety of waterfront experiences.

The EPX2 Resilient Waterfront Platform is an elevated Waterfront Resiliency solution for increasing natural disaster risk. It is an Adaptation solution, which includes the integrated assembly of two, independent structures—a Landside Structure and a Waterside Structure—to form one composite, cohesive Waterfront Resiliency infrastructure solution.

The subassembly of the Landside and Waterside Structures includes five Building Blocks, components, or parts—Vertical Accessway, Horizontal Accessway, Seawall, Pier, and Building. Together and integrated, they provide Waterfront Resiliency and an efficient and practical platform for a land use plan and an array of potential community experiences, functions, uses, elements, and appurtenances atop.

The EPX2 Resilient Waterfront Platform provides a highly resilient, highly efficient, standardized method for the establishment of new permanent infrastructure to protect new, existing, and historic waterfronts and coasts around the world.

Resiliency benefits include its elevated design, adaptation consistency, and isolation between the landside and waterside structures, as described below.

The EPX2 Resilient Waterfront Platform is an elevated solution, elevated above the projected future flood elevation. The elevation computational formula includes a climate change adjustment to account for sea level rise, increasing storm frequencies and intensities, and other climate change factors. Elevation is the adaptation model of choice to mitigate flood risk. It is preferred, more dependable, more lasting, and provides better and stronger water barrier protection than dry floodproofing and nonadaptation solutions at existing and too low waterfront elevations. Dry floodproofing measures are less safe when subjected to higher velocity water, hydrodynamic and wave loads, especially in coastal flood zones.

The EPX2 Resilient Waterfront Platform offers adaptation consistency. The infrastructure is continuous and continuously elevated along the waterfront with all componentry fully integrated. The consistency provides uniform structural integrity, strength, and stability, and a cohesive single line of strong water barrier defense along the waterfront to combat potential flood, sea level rise, and earthquake disasters. Structural solution consistency offers greater quality and performance protection and prevents weak links or possible "holes-in-the-dike" of waterfront armoring infrastructure.

The EPX2 Resilient Waterfront Platform isolates the waterside and landside structures to allow them to move and act independently, without impacting each other, during an adverse event. Separating the structures and creating a perimeter climate change and seismic gap prevent force transference and pounding between the landside and waterside structures, originating from the ground and the water, caused by sea level rise, extreme storm and tidal action, tsunamis, earthquakes, ground subsistence, etc. Although isolated, the two structures are synchronized, aligned, and seamlessly integrated with joint covers to provide uniform floor functionality and appearance.

Efficiency benefits are gained by minimizing waterfront utilization and the development footprint, computational and process standardization, and componentry standardization, as described below. These efficiencies reduce costs, implementation time, and impacts on the environment.

The EPX2 Resilient Waterfront Platform minimizes the utilization of the waterfront. The development footprint area is kept small, compact and virtually matches the existing waterfront footprint while adding vertical access to the elevated platform. Minimization of waterfront utilization yields spatial, land, water, environment, material, sustainability, and cost efficiencies. All are beneficial to support the adaptation of typically highly constrained waterfront sites. Environmental impacts and waterside encroachment are minimized, and where possible, existing waterfront components are adaptively reused.

The EPX2 Resilient Waterfront Platform provides a standardized process and method, including computational formulas, to elevate and solve the waterfront resiliency problem and to minimize the waterfront utilization and development footprint. Standardization provides legibility, minimizes complexity, and eases adoption and use of the waterfront infrastructure platform.

This process standardization drives componentry standardization and the potential repeatability of assembly components, and even their possible modularization, which suggest even further cost efficiencies including economies of scale for initial capital investment and later operations and maintenance. Standardization of piers is particularly useful and attractive for a pier restack, replacement, and re-occupancy program along a multiple-pier waterfront.

Overall, the EPX2 Resilient Waterfront Platform is optimized, delivers a sweet-spot balance of resiliency and efficiency benefits. It is a practical and lasting waterfront resiliency solution that offers reasonably maximal waterfront protection in the minimal amount of space, in virtually the same existing waterfront position.

This optimized EPX2 Resilient Waterfront Platform is particularly effective and beneficial for an existing or historic waterfront, where maintaining the existing integrity of the place or saving the original waterfront experience and history are goals. The waterfront is made enduringly resilient, by elevating, slightly moving and rebuilding structures, into an identical configuration and nearly identical footprint.

Alternatively, the EPX2 Resilient Waterfront Platform provides optionality along the Waterfront. The solution is flexible and adjustable. Modulation of the platform width unlocks the potential for larger development footprints and a greater variety of waterfront experiences.

The EPX2 Resilient Waterfront Platform provides optimal elevated flood adaptation and flood adaptation consistency along a waterfront. The EPX2 Resilient Waterfront Platform is a timely, legible, practical disaster prevention solution available to communities around the world today to apply and to protect new, existing, or historic waterfronts, including the protection of public health and safety and real property, including possible historic fabric, against flood hazards, sea level rise, earthquakes, and other adverse events.

Not all embodiments are required to have all of the features, characteristics and advantages described above.

BRIEF DESCRIPTION OF THE DRAWINGS

Embodiments of the disclosure have other advantages and features which will be more readily apparent from the following detailed description and the appended claims, when taken in conjunction with the examples in the accompanying drawings, in which:

DETAILED DESCRIPTION OF THE PREFERRED EMBODIMENTS

The figures and the following description relate to preferred embodiments by way of illustration only. It should be noted that from the following discussion, alternative embodiments of the structures and methods disclosed herein will be readily recognized as viable alternatives that may be employed without departing from the principles of what is claimed.

The EPX2 Resilient Waterfront Platform is a new and useful process, a resilient building technology approach that provides for the efficient adaptation and safeguard of waterfronts against adverse events. It is an optimized, elevated waterfront resiliency infrastructure solution that is legible, practical, high quality, highly efficient, and deployable, and provides a timely go-to standard for new and existing waterfront communities and historic districts at risk to climate change.

The EPX2 Resilient Waterfront Platform infrastructure pertains to several crossover fields of endeavor and subject matters including the environment, sustainability, and infrastructure, overall, and climate change and resiliency, more specifically.

Figure 1:
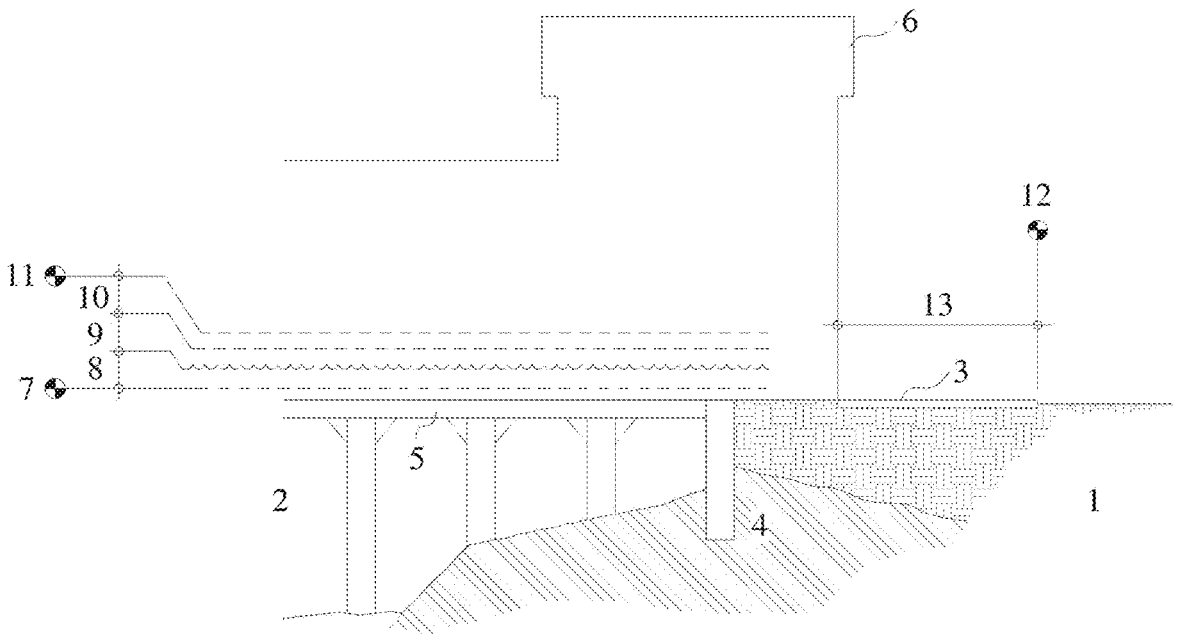
FIG. 1 illustrates a generalized situation of an existing waterfront.
Figure 2:
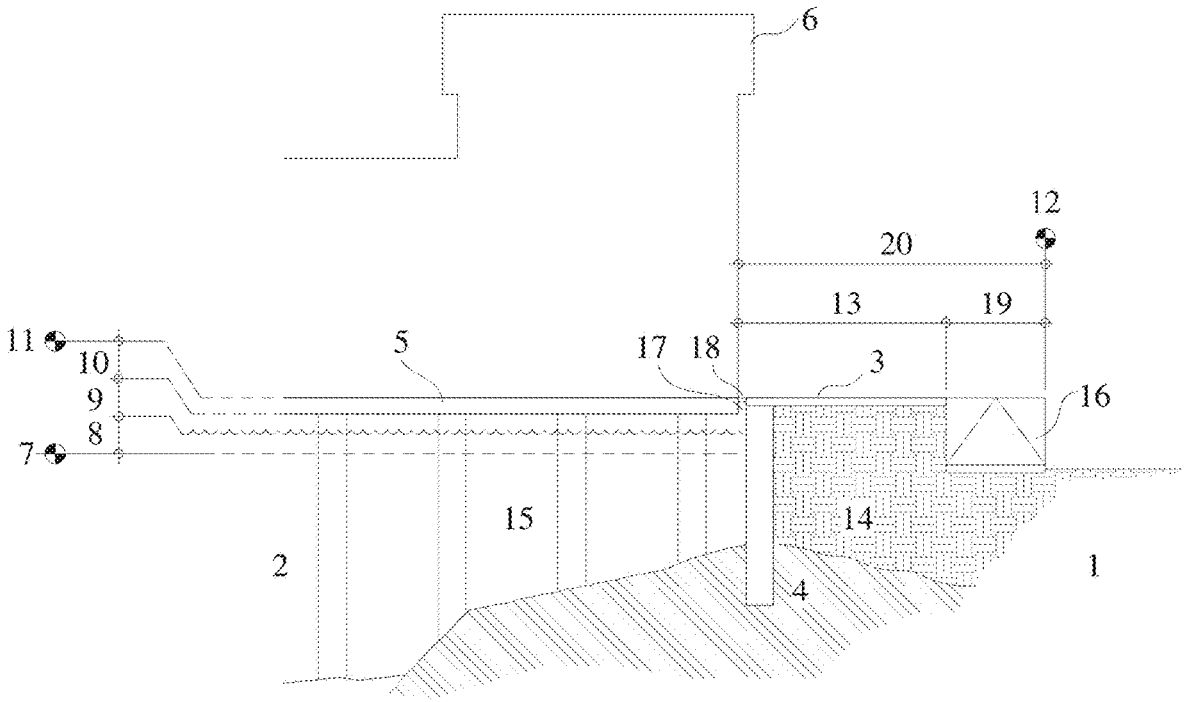
FIG. 2 illustrates an example embodiment of the EPX2 Resilient Waterfront Platform.

Various embodiments are illustrated by the drawing. The drawing shows two figures, FIG. 1 and FIG. 2. FIG. 1 is a generalized version of an existing waterfront. FIG. 2 is an example embodiment of the EPX2 Resilient Waterfront Platform and its application to that generalized version of an existing waterfront in FIG. 1.

Other existing waterfronts will vary, and the corresponding application and adaptation of the EPX2 Resilient Waterfront Platform to those other existing waterfronts will vary.

The drawing and Figures and the following brief description of the elements in the Figures should not be used to limit the scope of patent protection.

Identical reference numerals are used to correspond to similar elements in the two Figures. The elements are similar but are not necessarily identical.

Capitalized elements in the following brief description refer to the definitions for the EPX2 Resilient Waterfront Platform, as provided in the following.

FIG. 1 illustrates a generalized situation of an existing waterfront, with its landside 1 and waterside 2, and including a horizontal accessway 3, seawall 4, pier 5, and building (or other waterside structure) 6. The horizontal accessway 3 and seawall 4 are substantially on the landside 1 of the waterfront. The pier 5 and building 6 are substantially on the waterside 2 of the waterfront.

Vertical plane elevations and dimensions are flood elevation 7, sea level rise 8, freeboard (margin of safety) 9, pier structure depth 10, and waterfront platform elevation 11. These vertical plane dimensions illustrate the EPX2 Resilient Waterfront Platform Elevation Formula.

FIG. 1 shows that the general elevation of the existing waterfront, including the top of the horizontal accessway 3, seawall 4, pier 5, and floor of building 6, is too low, even below the current flood elevation 7, notwithstanding the projected future flood elevation due to sea level rise 8.

The general elevation of the existing waterfront—the top of the horizontal accessway 3, seawall 4, pier 5 and floor of building 6—should instead generally align at waterfront platform elevation 11 and provide a safe clearance of freeboard 9 above the current flood elevation 7 and projected sea level rise 8.

Horizontal plane lines and dimensions are waterfront boundary 12 and horizontal accessway width 13.

Actual conditions compared to this generalized situation of an existing waterfront will vary. For example, without limitation, a pier may not be present or may have other uses or no building atop, and the relative positions and extent of flood elevations and structures, including the seawall, and any associated rock dike or other componentry, will vary.

FIG. 2 is an example embodiment of the EPX2 Resilient Waterfront Platform, with its Landside 1 and Waterside 2 and including an independent Landside Structure 14 and an independent Waterside Structure 15 along the Waterfront. The Landside Structure 14 includes a Vertical Accessway 16, Horizontal Accessway 3, and Seawall 4. The Waterside Structure 15 includes the Pier 5 and Building 6. The Structural Interface 17 and corresponding Expansion or Seismic Joint Cover 18 separates structures 14 and 15.

Vertical plane elevations and dimensions are Flood Elevation 7, Sea Level Rise or Climate Change Adjustment 8, Freeboard 9, Pier Structure Depth 10, and Waterfront Platform Elevation 11. These vertical plane dimensions correspond to the EPX2 Resilient Waterfront Platform Elevation Formula.

FIG. 2 shows that the existing Waterfront is elevated higher. The general elevation of the Waterfront—the top of the Horizontal Accessway 3, Seawall 4, Pier 5, and floor of Building 6—generally aligns at Waterfront Platform Elevation 11. The Waterfront Platform Elevation is sufficiently high and provides a safe clearance of Freeboard 9 above the current Flood Elevation 7 and projected Sea Level Rise or Climate Change Adjustment 8.

Horizontal plane lines and dimensions are Waterfront Boundary 12, Horizontal Accessway Width 13, Vertical Accessway Width 19, and Waterfront Platform Width 20. These horizontal plane dimensions illustrate the EPX2 Resilient Waterfront Platform Width Formula.

Compared to the existing waterfront, the position of the Waterfront Boundary 12 and Horizontal Accessway Width 13 are identical, providing a similar experience, while the position of the Horizontal Accessway is slightly shifted to the Waterside 2 to accommodate the insertion of the Vertical Accessway 16 at the Waterfront Boundary 12. The position of the waterside edge of the Horizontal Accessway 3 establishes the relative position of the Seawall 4, Pier 5, and Building 6.

The application of the EPX2 Resilient Waterfront Platform to an existing waterfront will vary. For example, without limitation, a pier may not be present or may have other uses or no building atop, and the relative positions and extent of flood elevations and structures, including the seawall, and any associated rock dike or other componentry, will vary.

This approach also allows for the Adaptive Reuse and Historic Treatment of existing waterfront assembly elements, in whole or in part, including an existing building, sea wall, and any associated rock dike or other waterfront componentry.

The following more detailed description begins with the following series of general definitions.

Resiliency or resilience is the ability to prepare and plan for, absorb, recover from, and more successfully adapt to adverse events.

Adaptation is the process of adjustment to actual or expected adverse events, including climate change and its effects, to moderate or avoid harm or create beneficial outcomes.

Climate Change is a change in global or regional climate patterns, including sea level rise, attributed to increased levels of atmospheric carbon dioxide produced by using fossil fuels.

Coast or coastline typically refers to land which borders the ocean, sea, bay, and other bodies of salt water, which can be subjected to tidal action, waves, and sea level rise.

Waterfront is land, land with buildings and other uses, or a section of a real estate development, community, town, city, or urban area, which borders a body of water such as a river and lake, or a bay, sea, and ocean, along their coastlines.

Resiliency solutions for sea level rise can broadly fall into three basic and generic Adaptation solution categories—Retreat, Accommodation, and Protection.

Retreat is the withdrawal from a waterfront area and the shift of habitation away from it, landward, preferably to higher ground. Retreat discontinues habitation of the waterfront area and offers no protection of the existing land.

Accommodation provides for the continued habitation of the waterfront area and offers no protection of the existing land. Accommodation solutions include elevating buildings on piles.

Protection provides for the continued habitation of the waterfront area and offers protection of the existing land. Protection solutions include seawalls, dikes, dunes, and vegetation, and combinations thereof, to protect the land from the sea or a body of water so that existing land uses can be retained.

Adaptive Reuse is the process of repurposing existing Waterfront components, including rock dikes, sea walls, and buildings, in whole or in part, for new applications and modern functions.

Historic Treatment is the process of adapting existing, historic Waterfront components, including rock dikes, seawalls, buildings, and other historic fabric, to be more resilient to flood risk while preserving their historic character, in whole or in part.

Standardization is the extensive use of components, methods, or processes in which there is regularity, repetition and a background of successful practice and predictability.

Restack is the relocation of a tenant, business, use, or portions thereof, within a building, a pier, a waterfront, or set of buildings and piers.

Swing Space is a temporary location for a tenant, business, use, or portions thereof, pending the availability of the final or permanent location.

The above series of general definitions support the specific detailed description of the EPX2 Resilient Waterfront Platform, as follows.

The EPX2 Resilient Waterfront Platform is an elevated Waterfront Resiliency solution. It is a hybrid Adaptation solution, which pairs, integrates, and includes two, separate elevated structures—a Landside Structure and a Waterside Structure—to form one composite, cohesive Waterfront Resiliency infrastructure solution.

The hybrid Adaptation solution mates a Protection Adaptation solution with an Accommodation Adaption solution for the Landside Structure and Waterside Structure, respectively.

Landside refers to the portion of the EPX2 Resilient Waterfront Platform in, on, or above the land.

The Landside Structure is a Protection Adaptation solution. The Landside Structure is elevated. It is an independent structure on the Landside of the Waterfront, including the integrated assembly of three Building Blocks—Vertical Accessway, Horizontal Accessway, and Seawall. The Landside Structure typically continuously borders and aligns with the Waterfront.

Waterside refers to the portion of the EPX2 Resilient Waterfront Platform in, on, or above the water.

The Waterside Structure is an Accommodation Adaptation solution. The Waterside Structure is elevated. It is an independent structure on the Waterside of the Waterfront, typically supported by piles, including the integrated assembly of two Building Blocks—a Pier and its uses, including a Building. A Waterside Structure typically abuts, often perpendicularly, the Landside Structure and is typically intermittently placed along the Waterfront.

Structural Interface is the line between the Landside Structure and Waterside Structure and is a small gap or joint between the two independent structures where they abut and almost meet. The small gap in the EPX2 Resilient Waterfront Platform separates the Landside and Waterside Structures allowing them to move and act independently during an adverse event.

Isolating the structures and creating a perimeter Climate Change and/or seismic gap prevent force transference and pounding between the landside and waterside structures, originating from the ground and the water, caused by extreme storm and tidal action, sea level rise, tsunamis, earthquakes, ground subsistence, etc.

Expansion or Seismic Cover occurs at the Structural Interface and straddles the small gap or joint between the Landside Structure and Waterside Structure. The cover provides a continuous surface of similar elevation between the Horizontal Accessway and Pier, while allowing the Waterfront Structures to move and act independently during an adverse event.

The EPX2 Resilient Waterfront Platform includes the integrated assembly of the Landside and Waterside Structures. The assembly is vertically and horizontally aligned and typically includes five basic Building Blocks, components, or parts—Vertical Accessway, Horizontal Accessway, Seawall, Pier, and Building.

Together, the assembly of the Landside and Waterside Structures form the EPX2 Resilient Waterfront Platform. Together and separately, they provide Waterfront Resiliency and a base or platform for an array of potential community waterfront experiences, uses, elements, and appurtenances.

The five basic components or Building Blocks of the EPX2 Resilient Waterfront Platform are described as follows.

Vertical Accessway is a pathway, like a ramp, steps, stairway, lift, or similar, of manufactured or natural materials, which traverses the change in elevation from the Waterfront Boundary to the elevated Horizontal Accessway. It provides a vertical connection to the Horizontal Accessway typically at regular intervals, for example, at the intersections of city blocks, for pedestrians, cyclists, and other modes of transportation to the waterfront. Vertical access to the Horizontal Accessway for larger vehicles typically occurs at the ends of the Horizontal Accessway or at less frequent intervals.

Horizontal Accessway is generally a built, landscaped path, sidewalk, boardwalk, promenade, or similar element, of manufactured or natural materials, that continuously aligns with the water's edge or coastline and provides access for pedestrians, cyclists, small vehicles, and others to the water's edge. A Horizontal Accessway can have a variety of uses beyond circulation including a landing stage for boats, a wharf, and a base for open space, buildings, parks, recreation, strolling, entertainment, vehicular parking, etc.

Seawall is the water barrier or coastal armoring structure of manufactured or natural materials that protects and prevents water from reaching the Landside. The Seawall structurally separates the Landside from the Waterside, is continuous along the Waterfront, and protects the land from the sea or body of water. An existing Seawall and its associated componentry may be adaptively reused, in whole or in part, integrated, and potentially serve as a secondary line of flood disaster defense.

Pier is a structure typically supported on piles leading from the shore and Horizontal Accessway into a body of water, from the Landside to the Waterside. A Pier can abut and be intermittently placed along the Seawall. A Pier can have a variety of uses including a landing stage for boats and a base for buildings, parks, recreation, strolling, entertainment, vehicular parking, etc. Given height and structural limitations, an existing Pier substructure is an unlikely candidate for Adaptive Reuse. Demolition and replacement are likely required.

Building is a relatively permanent enclosed construction on a Pier, Horizontal Accessway or Waterfront used for a variety of activities, including business, entertaining, living, manufacturing, and other. A Building may be new, existing, or historic. An existing or historic building may be adaptively reused, historically treated, or similar, in whole or in part. Adaptive Reuse and Historic Treatment can include demolition, dismantling, moving, strengthening, elevating, reassembling, rebuilding, etc. Existing and historic waterfront buildings typically must be moved or relocated if they are to be saved for an enduring period.

The vertical plane (y-axis) of the EPX2 Resilient Waterfront Platform includes four elevations or vertical dimensions to establish the EPX2 Resilient Waterfront Platform elevation—Flood Elevation, Sea Level Rise or Climate Change Adjustment, Freeboard, and Pier Structure Depth—described as follows.

Flood Elevation is the projected elevation of rising floodwater. Flood Elevation only accounts for today's flood risk and does not account for future impacts, like sea level rise or other conditions, including other conditions arising from climate change. More severe storms and floods, producing flood levels higher than the current Flood Elevation, can and do occur. Today's Flood Elevation will likely occur more frequently in the future, and future Flood Elevations will increase above today's Flood Elevation.

Sea Level Rise is the projected dimensional increase in sea level caused by a change in the volume of the world's oceans and changes in local ground elevations. Although Sea Level Rise is technically zero for land-locked, fresh bodies of water, a similar climate change-driven projection may be necessary. Overall, this projected Sea Level Rise increase serves as a Climate Change Adjustment to account for future Flood Elevations along any Waterfront due to conditions like sea level rise, subsidence, shoreline erosion, increased storm frequency/intensity, etc.

Freeboard is the planned dimensional factor of safety for extraordinary or unknown flood risk that can cause flood heights to rise above the current or future Flood Elevation. Freeboard is measured to the Bottom of the Pier structure. It represents the clearance between the bottom of the Pier and the future Flood Elevation and is an indicator of a structure's capacity to withstand a future flood disaster.

Pier Structure Depth is measured from the bottom of the Pier structure to the top of the Pier structure. The bottom of the Pier structure is the lowest horizontal member of the Pier. The top of the Pier structure is the top of the pier deck.

Flood Elevation, Sea Level Rise, Freeboard, and Pier Structure Depth are the four vertical plane dimensions for the EPX2 Resilient Waterfront Platform. Together, they establish the necessary benchmark elevation of the EPX2 Resilient Waterfront Platform, to elevate it above the projected current and future Flood Elevation, with Freeboard, to minimize flood risk.

Waterfront Platform Elevation equals the sum of the four vertical plane dimensions—Flood Elevation, Sea Level Rise or Climate Change Adjustment, Freeboard and Pier Structure Depth. Waterfront Platform Elevation is the benchmark elevation of the EPX2 Resilient Waterfront Platform and provides for the alignment of the top of the Landside Structure with the top of the Pier.

EPX2 Resilient Waterfront Platform Elevation Formula is the computation for the Waterfront Platform Elevation, which equals the sum of the four vertical plane dimensions—Flood Elevation, Sea Level Rise or Climate Change Adjustment, Freeboard and Pier Structure Depth.

The elevated EPX2 Resilient Waterfront Platform, including its two integrated and vertically aligned Landside and Waterside Structures, provides Resiliency for the Waterfront.

The horizontal plane (x-axis) of the EPX2 Resilient Waterfront Platform includes three lines or horizontal dimensions to establish the position of the EPX2 Resilient Waterfront Platform—Waterfront Boundary, Vertical Accessway Width and Horizontal Accessway Width—described as follows.

Waterfront Boundary represents the starting point or line to establish the position of the EPX2 Resilient Waterfront Platform. The Waterfront Boundary matches the existing waterfront boundary and is the edge of the existing waterfront development footprint. That existing edge serves as the same landside limit of the EPX2 Resilient Waterfront Platform, the edge of development furthest from the water.

The Horizontal Accessway Width matches the horizontal dimension of the existing horizontal accessway to provide an efficient, similar experience. This matching and minimum width occurs only in the locations of the Vertical Accessways.

The Vertical Accessway Width is an initial dimensional allowance on the order of one-half or less of the Horizontal Accessway Width, representing approximately half of the traffic or one-way traffic. The dimensional allowance is subject to further adjustment to match actual traffic requirements.

Waterfront Boundary, Horizontal Accessway Width, and Vertical Accessway Width are the three horizontal plane dimensions for the EPX2 Resilient Waterfront Platform. Together, they establish the position and width of the EPX2 Resilient Waterfront Platform to minimize Waterfront utilization, the development footprint, and Waterside encroachment.

Waterfront Platform Width equals the sum of two horizontal plane dimensions—Horizontal Accessway Width and Vertical Accessway Width. It is the overall width of the EPX2 Resilient Waterfront Platform.

The Landside position of the Waterfront Platform Width begins at the Waterfront Boundary.

EPX2 Resilient Waterfront Platform Width Formula is the computation for the Waterfront Platform Width, which equals the sum of two horizontal plane dimensions—Vertical Accessway Width and Horizontal Accessway Width.

The Waterfront Platform Width is minimized and drives the efficiency of the EPX2 Resilient Waterfront Platform. When compared to the existing waterfront, the EPX2 Resilient Waterfront Platform is slightly wider to accommodate only the insertion of the Vertical Accessway.

With the Waterfront Platform Width minimized and its position established by the Waterfront Boundary, the EPX2 Resilient Waterfront Platform is compact and efficient.

Waterfront utilization, the development footprint, Waterside encroachment, and environmental impacts are minimized. The solution is spatially, land, water, environment, material, sustainability, and cost efficient. All are beneficial to support the adaptation of typically highly constrained waterfront sites.

Adaptive Reuse offers additional efficiency, environmental and sustainability benefits.

With the EPX2 Resilient Waterfront Platform virtually in the same location as the existing or historic waterfront, existing waterfront components can be adaptively reused and integrated into the platform.

Existing buildings or an existing seawall can be adaptively reused, in whole or in part. An existing seawall can serve as a secondary line of flood disaster defense to backstop the new seawall.

Adaptive Reuse of the existing seawall is more sustainable, environmentally friendly, and efficient, rather than the abandonment or costly removal, in whole or in part, of the structure for an entirely new one.

Overall, the EPX2 Resilient Waterfront Platform is resilient and efficient, at the respective Waterfront Platform Elevation, Waterfront Platform Width, and Waterfront Boundary position. It is an optimized solution and offers reasonably maximal elevated waterfront protection in the minimal amount of space.

EPX2 Resilient Waterfront Platform offers Standardization, which drives yet further efficiency gains. The platform provides a standardized process, including a standardized method, formulas, and assembly design.

The Waterfront Platform Elevation, Waterfront Platform Width and Waterfront Boundary are computed, then fixed. The fixed dimensions provide infrastructure universality, a consistent platform configuration, along the Waterfront.

The EPX2 Resilient Waterfront Platform standardized process promotes repeatability of its assembly components, including the Standardization of Landside and Waterside Structures, the five Building Blocks, and other possible elements along the Waterfront and segments of it. Standardization of the platform componentry unlocks the potential for greater off-site construction, pre-assembly, and even possibly modularization.

Standardization extends to the potential for a standardized Pier replacement program across a multiple-pier Waterfront. Rather than a patchwork of independent pier solutions along the Waterfront, a more holistic, standardized Pier replacement program provides a more cohesive line of Waterfront protection, greater public safety and value, including economies of scale for initial capital investment and later operations and maintenance.

Standardized Piers can be more useful, easily managed, and more flexible, for varying uses and Buildings atop. They can be viewed much like standard, interchangeable plug-and-play cartridges or thumb drives, when inserted and integrated with the Seawall.

Standardized piers can be especially useful during a Restack program of a multiple-pier waterfront. Existing Waterfront tenants and uses will need to be relocated and moved—temporarily to Swing Space or permanently—to allow for the new Seawall and Pier replacement construction to proceed. New, modernized, and standardized Piers are an ideal solution, an attractive, tenant-retention upgrade over the tenant's existing Pier space.

Standardization of assembly components further amplifies the efficiency of the already efficient EPX2 Resilient Waterfront Platform. Additional benefits are enhanced time, cost, and quality performance, which lead to better and earlier protection of the Waterfront, and public health and safety.

For new and existing waterfronts, The EPX2 Resilient Waterfront Platform provides optimal elevated flood adaptation and flood adaptation consistency along the Waterfront. Existing spatial relationships can be virtually maintained, as necessary, and new experiences and Building designs are possible atop the platform.

For historic waterfronts, the EPX2 Resilient Waterfront Platform keeps history together, and above water, by elevating and modernizing the waterfront. The EPX2 Resilient Waterfront Platform provides optimal elevated flood adaptation and flood adaptation consistency along the Waterfront, including among historically treated structures within an historic district.

Historic Treatment includes virtually maintaining the essential character and architectural integrity of historic buildings and historic districts, including maintaining historic seawalls, building heights, spatial relationships, treatments, and the user experience, as necessary.

The EPX2 Resilient Waterfront Platform can maintain a historic seawall in situ, in whole or in part, and adaptively reuse it as a possible secondary line of flood disaster defense. Adaptive reuse retains the historic fabric of the seawall in its original, historically correct location.

Alternatively, for new, existing, and historic waterfront applications, the EPX2 Resilient Waterfront Platform provides optionality along the Waterfront. The solution offers a framework that is flexible and adjustable. Modulation of the Waterfront Platform Width, as one example, primarily by increasing the widths of the Vertical and Horizontal Accessways or the location of the Waterfront Boundary, unlocks the potential for larger development footprints and potentially a greater variety of waterfront experiences.

Although the detailed description contains many specifics, these should not be construed as limiting the scope of the disclosure but merely as illustrating different examples. It should be appreciated that the scope of the disclosure includes other embodiments not discussed in detail above. Various other modifications, changes and variations which will be apparent to those skilled in the art may be made in the arrangement, operation and details of the method and apparatus disclosed herein without departing from the spirit and scope as defined in the appended claims. Therefore, the scope of the invention should be determined by the appended claims and their legal equivalents.

What is claimed is:

1. A method for creating a resilient platform for a waterfront comprising a waterside structure, the method comprising:

vertically raising the waterside structure to a waterfront platform elevation that is higher than a current waterfront elevation, that is above a current flood elevation, and that accommodates a projected future rise in the flood elevation, a factor of safety, and a pier depth of the waterside structure; and horizontally moving the waterside structure away from a landside of the waterfront, thus creating landside space to accommodate vertical access to the higher waterfront platform elevation.

2. The method according to claim 1, further comprising: reusing existing waterfront components.

3. The method according to claim 1, further comprising: historic treatment of existing waterfront components.

4. The method according to claim 1, wherein the method is based on standardized methods and standardized assembly components.

5. The method according to claim 4, wherein the standardization includes pier standardization and pier restacking.

6. The method according to claim 1, further comprising: horizontally moving a boundary of the waterfront away from a waterside of the waterfront.

7. The method according to claim 1, further comprising: horizontal adjustment of a configuration and/or dimension of a waterside component of the waterfront.

8. A resilient waterfront platform comprising a landside structure; the landside structure comprising:

a horizontal accessway that provides access to a waterside of a waterfront; wherein the horizontal accessway is vertically raised to a waterfront platform elevation that is higher than a current waterfront elevation, that is above a current flood elevation, and that accommodates a projected future rise in the flood elevation, a factor of safety, and a pier depth of a waterside structure; and a vertical accessway that provides access between the vertically raised horizontal accessway and a landside at the current waterfront elevation; wherein the vertical accessway occupies landside space created by horizontally moving the horizontal accessway away from the landside.

9. The resilient waterfront platform according to claim 8, wherein the landside structure further comprises:

a seawall assembly, which is elevated to the waterfront platform elevation.

10. The resilient waterfront platform according to claim 8, wherein the waterfront platform elevation is determined according to a waterfront platform elevation formula, which is a function of the current flood elevation, the projected future rise in the flood elevation, the factor of safety, and the pier depth of the waterside structure.

11. The resilient waterfront platform according to claim 8, wherein a width and a position of the waterfront platform are determined according to a waterfront platform width formula, which is a function of a width of the vertical accessway, a width of the horizontal accessway, and a landside position of a waterfront boundary.

12. The resilient waterfront platform according to claim 8, further comprising:

a reuse of existing waterfront components.

13. The resilient waterfront platform according to claim 8, wherein the waterfront platform is consistent with a historic treatment of existing waterfront components.

14. The resilient waterfront platform according to claim 8, wherein waterfront components comprise standardized assembly components.

15. The resilient waterfront platform according to claim 8, further comprising:

a structural interface that isolates and provides separation between the waterside structure and the horizontal accessway.

16. The resilient waterfront platform according to claim 8, wherein the waterside structure comprises a building supported by a pier.

17. The resilient waterfront platform according to claim 16, wherein the building and the horizontal accessway are aligned in elevation.

18. A method for creating a resilient platform for a waterfront comprising a landside structure, the method comprising:

vertically raising a horizontal accessway that provides access to a waterside of the waterfront to a waterfront platform elevation that is higher than a current waterfront elevation, that is above a current flood elevation, and that accommodates a projected future rise in the flood elevation, a factor of safety, and a pier depth of a waterside structure; and horizontally moving the horizontal accessway away from a landside of the waterfront, thus creating landside space to accommodate a vertical accessway that provides access to the vertically raised horizontal accessway.

19. The method according to claim 18, further comprising:

horizontal adjustment of a configuration and/or dimension of a landside component of the waterfront.

20. The method according to claim 18, further comprising:

horizontally adjusting a position of a boundary of the waterfront, adjusting a width of a vertical access to the horizontal accessway, adjusting a width of the horizontal accessway to the waterside of the waterfront, and/or adjusting a width of the resilient platform.

21. A resilient waterfront platform comprising a waterside structure; wherein the waterside structure (a) is vertically raised to a waterfront platform elevation that is higher than a current waterfront elevation, that is above a current flood elevation, and that accommodates a projected future rise in the flood elevation, a factor of safety, and a pier depth of the waterside structure; and (b) is horizontally moved away from a landside of a waterfront, thus creating landside space to accommodate vertical access to the higher waterfront platform elevation.

* * * * *